US010256566B2

(12) United States Patent
Eun

(10) Patent No.: US 10,256,566 B2
(45) Date of Patent: Apr. 9, 2019

(54) WATERPROOF ELECTRIC CONNECTOR

(71) Applicant: Sung-guen Eun, Seoul (KR)

(72) Inventor: Sung-guen Eun, Seoul (KR)

( * ) Notice: Subject to any disclaimer, the term of this patent is extended or adjusted under 35 U.S.C. 154(b) by 0 days.

(21) Appl. No.: 15/738,580

(22) PCT Filed: Apr. 26, 2016

(86) PCT No.: PCT/KR2016/004324
§ 371 (c)(1),
(2) Date: Dec. 23, 2017

(87) PCT Pub. No.: WO2017/034120
PCT Pub. Date: Mar. 2, 2017

(65) Prior Publication Data

US 2018/0198228 A1 Jul. 12, 2018

(30) Foreign Application Priority Data

Aug. 21, 2015 (KR) ..... 10-2015-0117680

(51) Int. Cl.

| | |
|---|---|
| ***H01R 13/52*** | (2006.01) |
| ***H01R 13/10*** | (2006.01) |
| *H01R 13/58* | (2006.01) |
| *H01R 13/622* | (2006.01) |
| *H01R 24/30* | (2011.01) |

(52) U.S. Cl.
CPC ..... *H01R 13/5202* (2013.01); *H01R 13/10* (2013.01); *H01R 13/5205* (2013.01);
(Continued)

(58) Field of Classification Search
CPC ..... H01R 13/04; H01R 13/10; H01R 13/42; H01R 13/52; H01R 13/5202; H01R 13/56; H01R 13/58; H01R 13/68
(Continued)

(56) References Cited

U.S. PATENT DOCUMENTS 4,441,777 A * 4/1984 Harootion ..... H01R 13/533 439/274
6,010,348 A * 1/2000 Alden ..... H01R 13/506 439/274
(Continued)

FOREIGN PATENT DOCUMENTS

JP H08-293355 A 11/1996
JP 2015-210997 11/2015
(Continued)

*Primary Examiner* — Edwin A. Leon
*Assistant Examiner* — Milagros Jeancharles
(74) *Attorney, Agent, or Firm* — Korus Patent, LLC; Seong Il Jeong

(57) ABSTRACT

The present invention provides a waterproof electric connector, including: first and second connectors configured such that first and second wire entry ends are provided at the first side ends of first and second housings; first and second packings configured to be inserted into the inner circumferences of the first and second wire entry ends; first and second finishing caps formed as blocking components which are coupled to the outer circumferences of the first and second wire entry ends; a coupling cap configured such that one side end thereof is coupled to the outer circumference of one side end of the second housing; and a connection packing part configured to include a first elastic packing and a second elastic packing.

3 Claims, 7 Drawing Sheets

(52) U.S. Cl.
CPC ..... *H01R 13/5812* (2013.01); *H01R 13/622* (2013.01); *H01R 24/30* (2013.01)

(58) Field of Classification Search
USPC ..... 439/270–282, 135
See application file for complete search history.

(56) References Cited

U.S. PATENT DOCUMENTS

| | | | | |
|---|---|---|---|---|
| 8,016,603 | B1 * | 9/2011 | Tsai | H01R 13/111 439/271 |
| 9,472,890 | B2 * | 10/2016 | Arai | H01R 13/5205 |
| 2003/0148652 | A1 * | 8/2003 | Bernardi | G02B 6/3879 439/462 |
| 2005/0075000 | A1 * | 4/2005 | Wu | H01R 13/5213 439/320 |
| 2006/0172578 | A1 * | 8/2006 | Parsons | H01R 13/5202 439/291 |
| 2013/0309883 | A1 * | 11/2013 | Wolfe | H01R 13/58 439/106 |

FOREIGN PATENT DOCUMENTS

| | | | | |
|---|---|---|---|---|
| JP | 2015210997 | A | * | 11/2015 |
| KR | 20-1998-0016443 | U | | 6/1998 |
| KR | 20-0365114 | Y1 | | 10/2004 |
| KR | 10-2008-0046465 | A | | 5/2008 |
| KR | 10-2011-0074832 | A | | 7/2011 |
| KR | 10-2013-0015803 | A | | 2/2013 |

* cited by examiner

WATERPROOF ELECTRIC CONNECTOR

TECHNICAL FIELD

The present invention relates to a waterproof electric connector, and more specifically to a waterproof electric connector which can couple a pair of electric connectors in order to prevent them from being separated by external pressure during a process of connecting the pair of electric connectors, which can maintain the water-tightness of connected portions, and which can maintain the water-tightness of gaps between wires configured to be passed through first side ends of the housings of the electric connectors and to be connected to connection components provided inside the housings and the first side ends of the housings.

BACKGROUND ART

Generally, various types of electric/electronic equipment or devices are connected to power supply sources through electric connectors (e.g., outlets and plugs), and are supplied with power required for operation. However, of these electric connectors, the outlets are open at their first ends such that plugs can be inserted thereinto from the outside, and thus various types of impurities may easily infiltrate thereinto from the outside in the state in which the plugs have been inserted thereinto.

In particular, an outlet or plug used in places having a large amount of water or moisture, such as a bathroom, an outlet or plug used for devices using electricity outdoor, such as a vending machine, an aquarium, a game machine, a refrigerator, etc., or an outdoor outlet or plug temporarily installed in a construction site or outdoor place has a problem in that rain water or moisture infiltrates from the outside to the inside and thus concern about the occurrence of a safety-related accident, such as a short circuit and electric shock, is high.

Furthermore, most conventional plugs and outlets use a coupling method in which each plug is simply inserted into each outlet. Accordingly, when the outlet and the plug are connected to each other, there frequently occurs a case where contact terminals located inside the outlet are not tightly connected to the terminal pins of the plug. In this case, the plug may be easily separated from the outlet by a small amount of external pressure, with the result that there frequently occurs a problem in which current is cut off and thus electric/electronic equipment or an electric/electronic device is stopped during operation.

In order to overcome the above problems of the conventional electric connectors, numbers of waterproof outlets and plugs, such as those shown in the accompanying FIGS. 1 and 2, have been introduced recently. However, these conventional waterproof outlets and plugs are configured such that the outlets are connected to the plugs in the state in which the plugs are simply surrounded with waterproof caps. These conventional waterproof outlets and plugs are structural defects in which rain water (including water) or moisture cannot be prevented from infiltrate into a cap between one side end of each plug body and a wire and also in that the waterproofing of a portion where each plug and each outlet are connected, as well as the waterproofing of the outlet itself, is impossible.

Prior art documents regarding the above-described waterproof electric connectors are as follows: Document 1: Korean Patent Application Publication No. 10-2008-0046465 (Waterproof Plug; filed on Nov. 22, 2006); and Document 2: Korean Patent No. 10-1219019 (Waterproof Plug and Outlet Structure; filed on May 23, 2011).

DISCLOSURE

Technical Problem

The present invention has been conceived to overcome the above-described problems, and an object of the present invention is to provide a waterproof electric connector which can couple a pair of electric connectors in order to prevent them from being separated by external pressure during a process of connecting the pair of electric connectors, which can maintain the water-tightness of connected portions, and which can maintain the water-tightness of gaps between wires configured to be passed through the first side ends of the housings of the electric connectors and to be connected to connection components provided inside the housings and the first side ends of the housings.

Technical Solution

In order to accomplish the above object, the present invention provides a waterproof electric connector, including: first and second connectors configured such that first and second wire entry ends whose inner circumferences narrow in inward directions are respectively provided at first side ends of the first and second housings accommodating first and second connection components, respectively; first and second packings configured to be inserted into the inner circumferences of the first and second wire entry ends in a surface contact manner and to maintain water-tightness; first and second finishing caps formed as blocking components which are coupled to outer circumferences of the first and second wire entry ends in order to guide first and second wires into the first and second housings, and configured such that first and second pressing members are provided on portions of inner sides of front ends of the first and second finishing caps corresponding to first sides of the first and second packings in the form of ring-shaped protrusions and press the first and second packings in a direction toward surfaces along which the inner circumferences of the first and second wire entry ends come into contact with the first and second wires through the pressing of first side surfaces of the first and second packings during a process of being coupled to the first and second wire entry ends; a coupling cap configured such that in a state in which one side end thereof has been fitted over an outer circumference of the first wire entry end, the other side end thereof is coupled to an outer circumference of one side end of the second housing which is connected to the first housing; and a connection packing part including, in portions where the first and second housings are coupled to each other by the coupling cap: a first elastic packing configured to be provided in a portion where the coupling cap and a front end of the second housing come into contact with each other, and to maintain water-tightness; and a second elastic packing configured to be provided in a portion where an inner circumferential surface of the second housing comes into contact with an outer circumferential surface of the first housing, and to maintain water-tightness.

Advantageous Effects

According to the present invention based on the above-described technical solution, in that in the state in which the first and second packings have been inserted into the inwardly narrowing inner circumferences of the first and second wire entry ends provided on the first side ends of the first and second housings, respectively, the first and second finishing caps are coupled to the outer circumferences of the first and second wire entry ends. Accordingly, the first and second pressing members provided on the first and second finishing caps press the first and second packings onto the surfaces where the inner circumferences of the first and second wire entry ends and the first and second wires come into contact with each other. As a result, the present invention is advantageous in that water can be prevented from infiltrating into gaps between the first and second wire entry ends of the first and second housings and the first and second packings, and is also advantageous in that water can be prevented from infiltrating into gaps between the first and second packings and the first and second wires in a dual manner.

Furthermore, according to the present invention, in the state in which one side end of the coupling cap has been inserted into the outer circumference of the first wire entry end, the other side end thereof is coupled to the outer circumference of one side end of the second housing connected to the first housing, and the connection packing part, i.e., the first and second elastic packings, are provided in the corresponding portions of the coupling cap and the first housing which come into contact with the front end and outer circumferential surface of the second housing accordingly. Accordingly, the first connector and the second connector are allowed to remain connected. As a result, the present invention is advantageous in that the connection between the first connector and the second connector can be prevented from being released by external pressure, and is also advantageous in that water can be prevented from infiltrating into a gap between the connection portions of the first connector and the second connector in a dual manner, thereby maintaining water-tightness.

Moreover, according to the present invention, the pair of wire movement prevention means formed to be symmetrical and configured to fasten each of the first and second wires exposed between the ribs of the first or second finishing cap while pressing the first or second wire are provided on the ribs provided on both sides around the through hole on the outside of the front end of each of the first and second finishing gaps. As a result, the present invention is advantageous in that the connection of the first and second wires passed through the first and second finishing gaps and the first and second wire entry ends of the first and second housings and connected to the first and second connection components can be prevented from being easily released by external pressure. In this case, when the wire movement prevention means have elasticity and are coupled to the front ends of the first and second finishing caps, water can be prevented from infiltrating into gaps between the first and second finishing caps and the first and second wires.

MODE FOR INVENTION

The present invention will be described in detail with reference to the accompanying drawings presented as described above, as follows.

Figure 1:
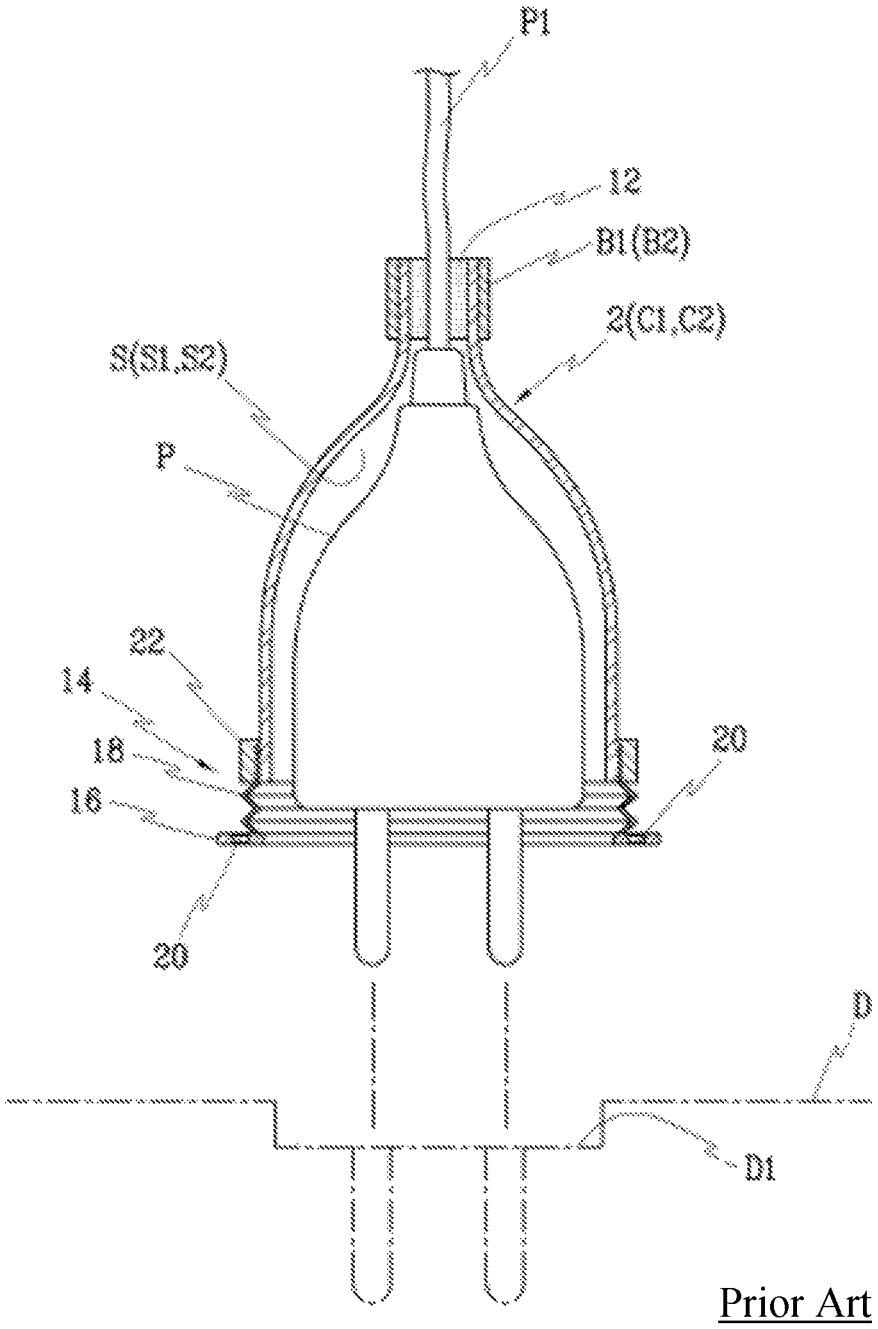
FIG. 1 is a diagram showing the configuration and structure of a conventional waterproof plug.
Figure 2:
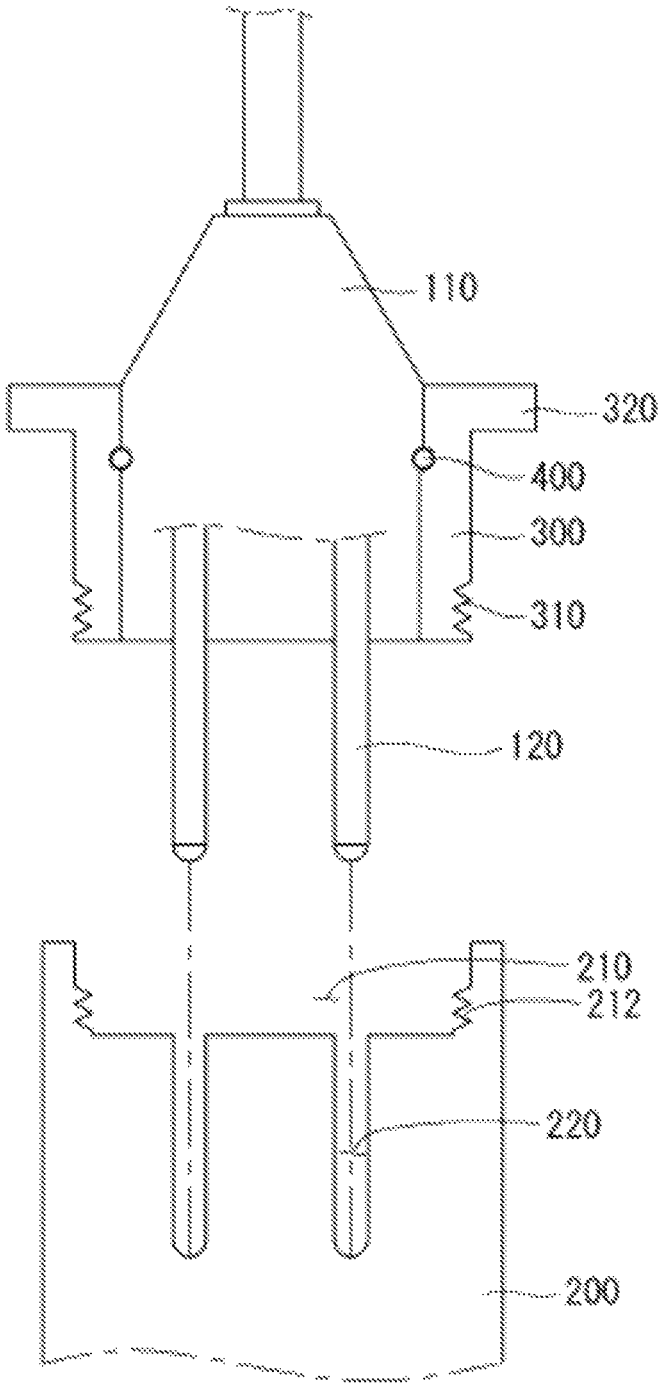
Prior Art FIG. 2
FIG. 2 is a diagram showing the configuration and structure of a conventional waterproof plug and outlet structure.
Figure 3:
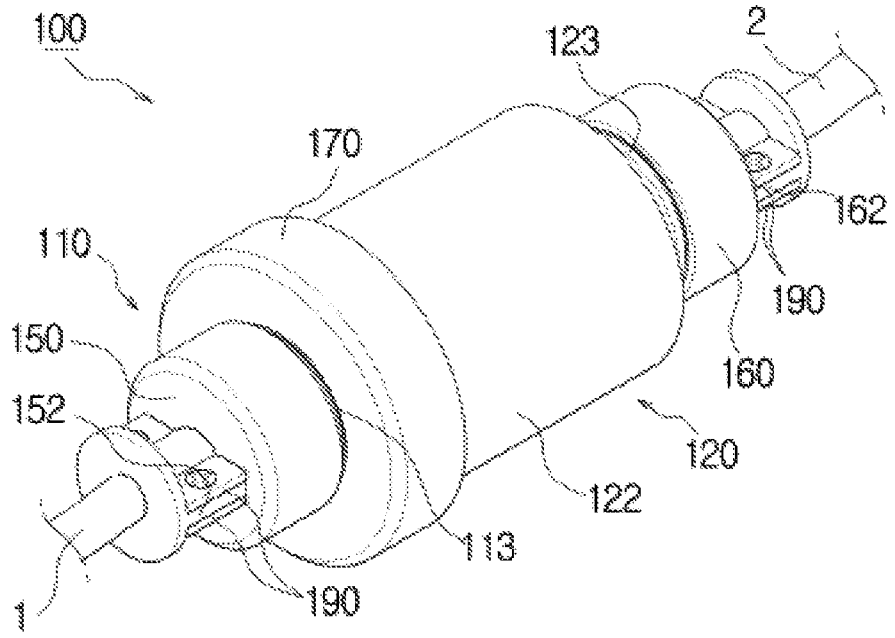
FIG. 3 is a perspective view showing a configuration according to an embodiment of the present invention.
Figure 4:
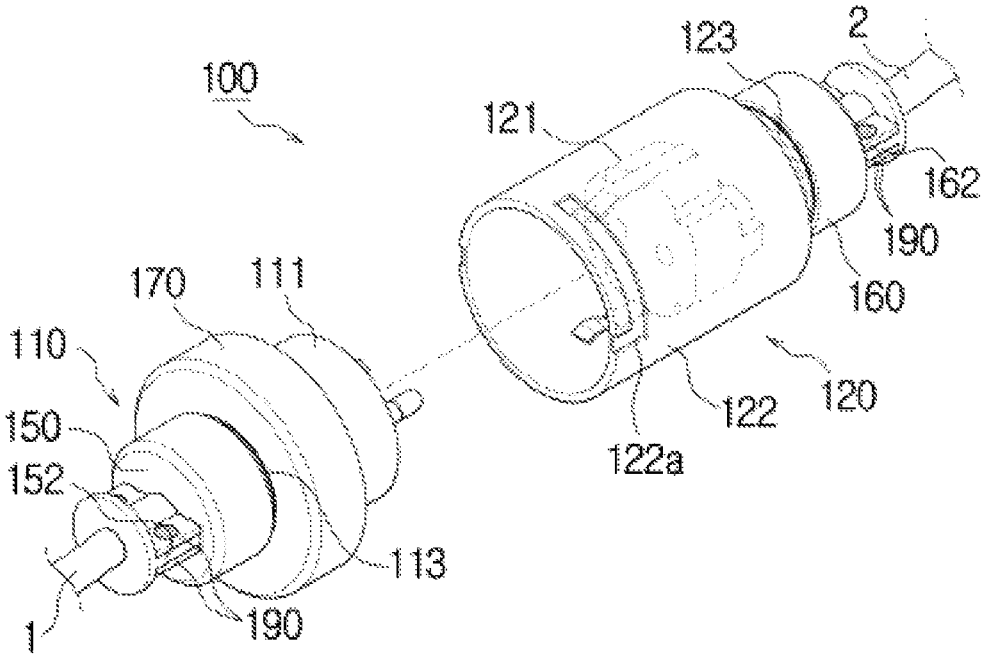
FIG. 4 is a perspective view showing the separated configuration according to the embodiment of the present invention.
Figure 5:
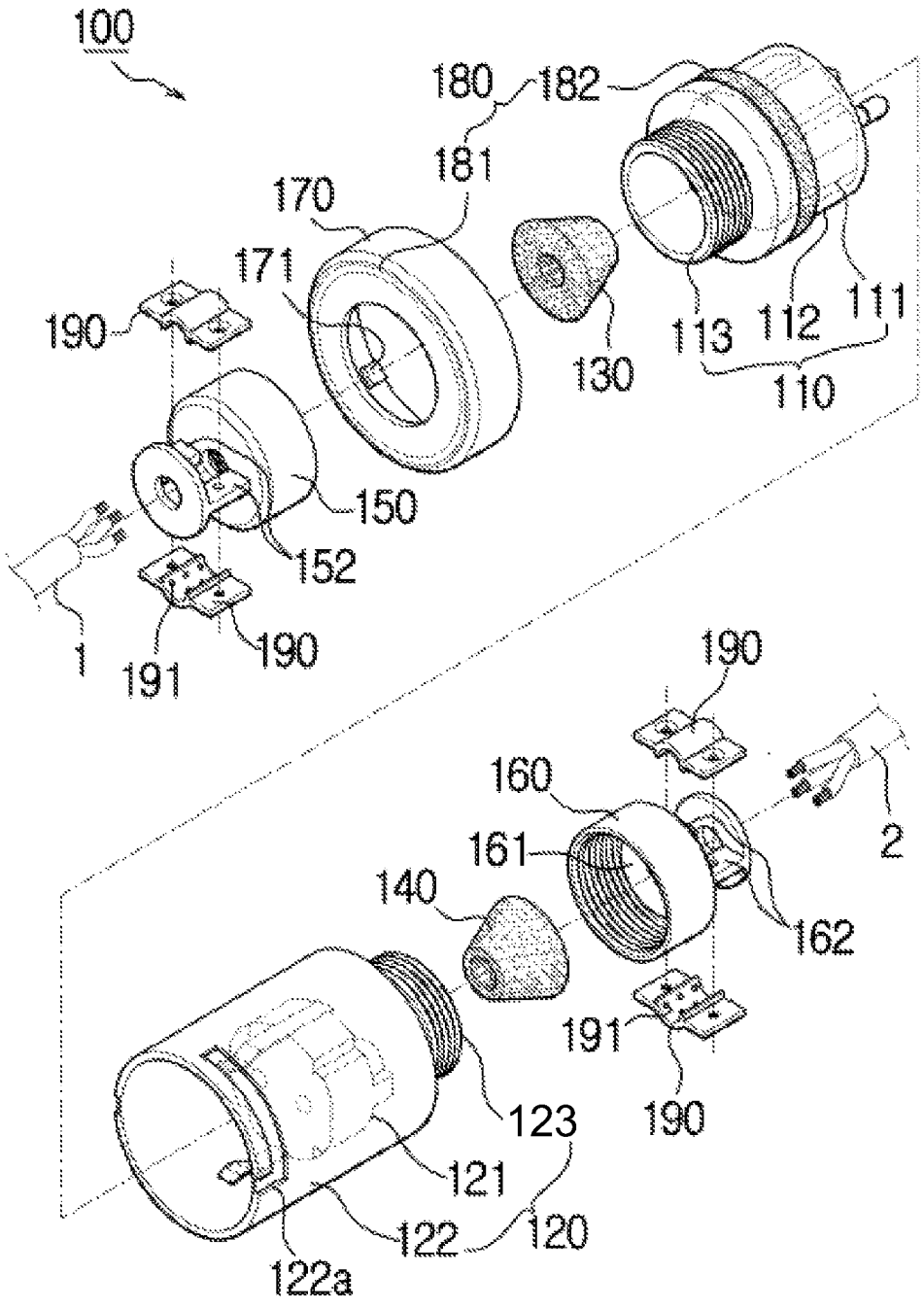
FIG. 5 is a perspective view showing the separated configuration according to the embodiment of the present invention in greater detail.

FIGS. 3 to 5 show the configuration of a waterproof electric connector according to an embodiment of the present invention. FIG. 3 is a perspective view showing the configuration according to the embodiment of the present invention, FIG. 4 is a perspective view showing the separated configuration according to the embodiment of the present invention, and FIG. 5 is a perspective view showing the separated configuration according to the embodiment of the present invention in greater detail.

According to the present invention, a waterproof electric connector 100 is configured to include first and second connectors 110 and 120, first and second packings 130 and 140, first and second finishing caps 150 and 160, a coupling cap 170, and a connection packing part 180, as shown in FIGS. 3 to 5.

In the first and second connectors 110 and 120, first and second wire entry ends 113 and 123 configured such that the inner circumferences thereof narrow in inward directions are respectively provided at the first side ends of the first and second housings 112 and 122 accommodating first and second connection components 111 and 121, respectively. The first and second packings 130 and 140 are inserted into the inner circumferences of the first and second wire entry ends 113 and 123, and maintain water-tightness. The first and second finishing caps 150 and 160 are blocking components which are coupled to the outer circumferences of the first and second wire entry ends 113 and 123 in order to guide first and second wires 1 and 2 into the first and second housings 112 and 122. First and second pressing members 151 and 161 configured to press the first and second packings 130 and 140 onto surfaces along which the inner circumferences of the first and second wire entry ends 113 and 123 are in contact with the first and second wires 1 and 2 are provided on the portions of the inner sides of the front ends of the first and second finishing caps 150 and 160 corresponding to the first sides of the first and second packings 130 and 140. The coupling cap 170 is configured such that in the state in which one side end thereof has been fitted over the outer circumference of the first wire entry end 113, the other side end thereof is coupled to the outer circumference of one side end of the second housing 122 which is connected to the first housing 112. The connection packing part 180 includes, in portions where the first housing 112 and the second housing 122 are coupled to each other by the coupling cap 170: a first elastic packing 181 configured to be provided in a portion where the coupling cap 170 and the front end of the second housing 122 come into contact with each other, and to maintain water-tightness; and a second elastic packing 182 configured to be provided in a portion where the inner circumferential surface of the second housing 122 comes into contact with the outer circumferential surface of the first housing 112, and to maintain water-tightness.

In this case, in the present invention, the first connection component 111 may be an electric plug or electric connector, and the second connection component 121 may be an electric outlet or electric connector.

In this case, the first connection component 111, i.e., an electric plug or connector, may be a finished product (formed in an integrated manner through injection molding) in which the first wire 1 and connectors (terminals) have been assembled together in advance, or may be a half-finished product in which first wire 1 will be screwed into connectors (terminals).

Furthermore, the second connection component 121, i.e., an electric outlet or electric connector, may be a finished product (formed in an integrated manner through injection molding) in which the second wire 2 and connectors (terminals) have been assembled together in advance, or may be a half-finished product in which second wire 2 is screwed into connectors (terminals).

Meanwhile, in the present invention, the first housing 112 may be a synthetic resin or rubber case configured to accommodate the first connection component 111, and the second housing 122 may be a synthetic resin or rubber case configured to accommodate the second connection component 121.

In this case, a ring-shaped protrusion may be formed on the outer circumferential surface of one side end of the first housing 112, and the second elastic packing 182 of the connection packing part 180 may be fitted over the ring-shaped protrusion. Alternatively, a ring-shaped depression may be formed through the outer circumferential surface of one side end of the first housing 112, and the second elastic packing 182 of the connection packing part 180 may be fitted into the ring-shaped depression.

Figure 6:
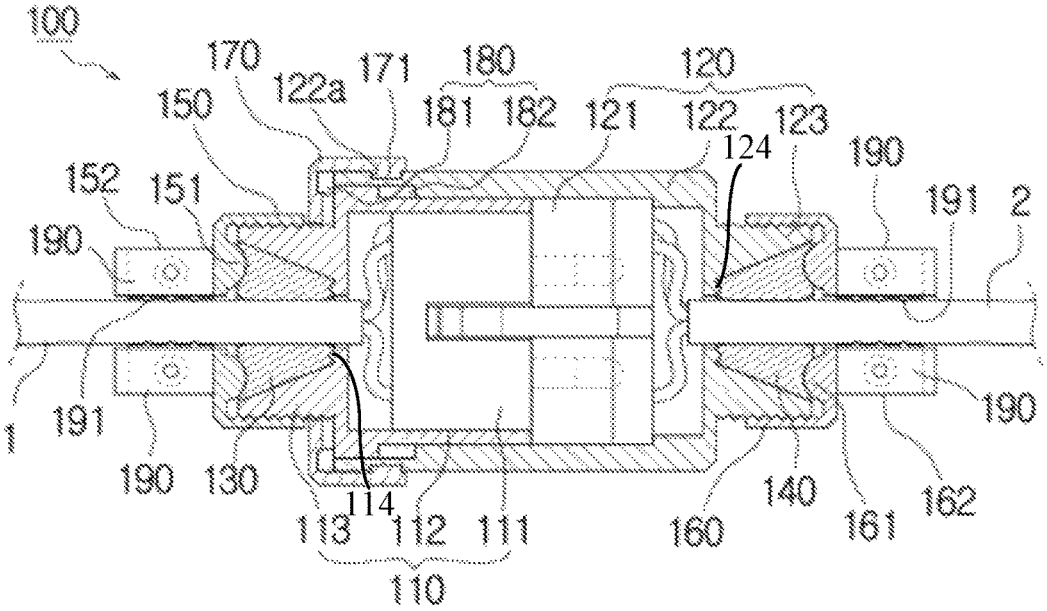
FIG. 6 is a sectional view showing the combined configuration according to the embodiment of the present invention in greater detail.
Figure 7:
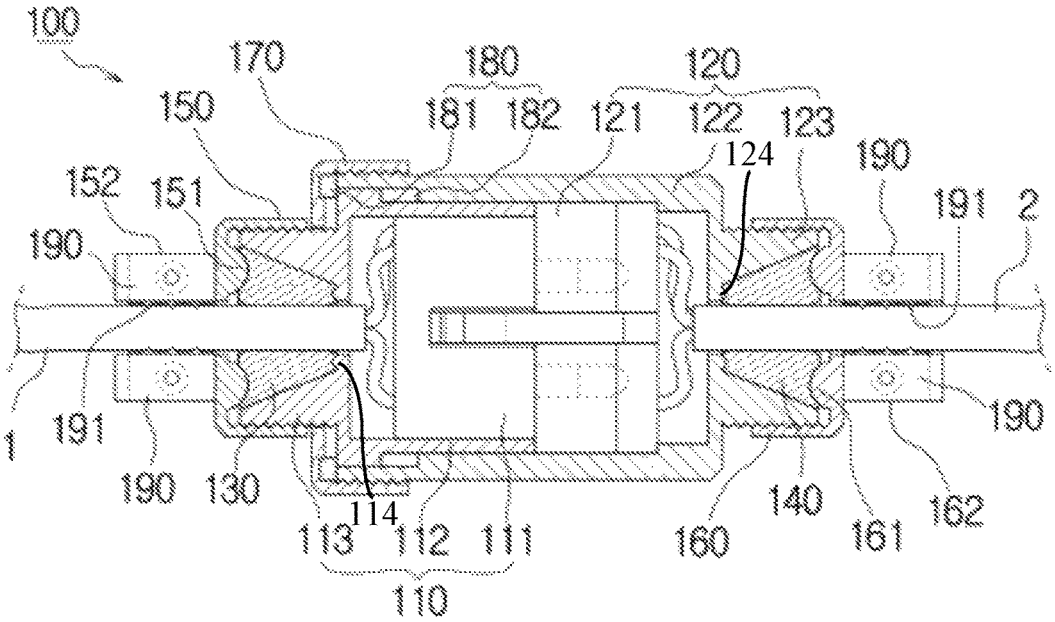
FIG. 7 is a sectional view showing another combined configuration according to an embodiment of the present invention in greater detail.

Furthermore, as shown in the accompanying FIG. 6, an "L"-shaped coupling depression 122*a* may be formed through the outer circumferential surface of the second housing 122 onto which the coupling cap 170 is coupled, and may be engaged with the "L"-shaped coupling depression 122*a* through rotation in the state in which a coupling protrusion 171 provided on the inner circumferential surface of the coupling cap 170 has been fitted thereinto. Alternatively, as shown in the accompanying FIG. 7, screw threads may be formed through the outer circumferential surface of the second housing 122 onto which the coupling cap 170 is coupled, and may be engaged with screw threads provided through the inner circumferential surface of the coupling cap 170 through rotation.

Meanwhile, in the present invention, the inner circumference of the first wire entry end 113 forms a central hollow shape in which the diameter of the front end thereof is long and the diameter thereof decreases in an inward direction. A ring-shaped pressing protrusion 114 may be formed on the inner hollow surface of the first wire entry end 113, and screw threads configured to be engaged with the first finishing cap 150 may be formed on the outer circumferential surface of the first wire entry end 113.

Meanwhile, in the present invention, the inner circumference of the second wire entry end 123 forms a central hollow shape in which the diameter of the front end thereof is long and the diameter thereof decreases in an inward direction. A ring-shaped pressing protrusion 124 may be formed on the inner hollow surface of the first second wire entry end 123, and screw threads configured to be engaged with the second finishing cap 160 may be formed on the outer circumferential surface of the first second wire entry end 123.

Meanwhile, in the present invention, the first finishing cap 150 may be a cover configured such that the center thereof is formed to be hollow and screw threads are formed on the inner circumferential surface thereof so that the cover is coupled to the first wire entry end 113 through engagement. Ribs 152 configured to provide surfaces for the coupling of wire movement prevention means 190 may be formed on both sides around a center through hole on the outside of the front end of the first finishing cap 150.

Furthermore, the first pressing member 151 provided on the surface portion of the first finishing cap 150 which is in contact with the first packing 130 may be a ring-shaped protrusion.

Meanwhile, in the present invention, the second finishing cap 160 may be a cover configured such that the center thereof is formed to be hollow and screw threads are formed on the inner circumferential surface thereof so that the cover is coupled to the second wire entry end 123 through engagement. Ribs 162 configured to provide surfaces for the coupling of the wire movement prevention means 190 may be formed on both sides around a center through hole on the outside of the front end of the second finishing cap 160.

Furthermore, the second pressing member 161 provided on the surface portion of the second finishing cap 160 in contact with the second packing 140 may be a ring-shaped protrusion.

In this case, the pair of wire movement prevention means 190 composed of symmetrical wire pressing members separated into both sides may be provided on the ribs 152 or 162 of each of the first and second finishing caps 150 and 160. In other words, the pair of wire movement prevention means 190 formed to be symmetrical and configured to fasten the first or second wire 1 or 2, exposed between the ribs 152 or 162, to the ribs 152 or 162 of the first or second finishing cap 150 or 160 while pressing the first or second wire 1 or 2 may be provided on the ribs 152 or 162 provided on both sides around the through hole on the outside of the front end of the first or second finishing cap 150 or 160.

In this case, wedge-shaped stoppers 191 configured to prevent movement may be provided on the curved surfaces of the wire movement prevention means 190 which are in contact with the wires.

Meanwhile, in the present invention, the coupling cap 170 may be a cover configured such that the center thereof is formed to be hollow and a coupling protrusion 171 or screw threads configured to be engaged with the coupling depression 122*a* or screw threads of the second housing 122 are formed on the inner circumferential surface thereof. The hollow center portion may be inserted over the first wire entry end 113, and the coupling cap 170 may be prevented from being separated by the first finishing cap 150 which is engaged with the first wire entry end 113.

Meanwhile, in the present invention, the connection packing part 180 may include: the first elastic packing 181 configured to be provided in a ring shape on the inner surface of the coupling cap 170 within the portion where the front end of the second housing and the coupling cap 170 come into contact with each other; and the second elastic packing 182 configured to be provided in a portion formed through the outer circumferential surface of the first housing 112 within the portion where the first housing 112 and the second housing 122 come into contact with each other.

The operation of the embodiment of the present invention configured as described above will be described, as follows.

First, according to the present invention, the first connection component 111, i.e., a plug, is inserted into one side of the first housing 112 so that plug terminals are exposed to the outside, and the first wire 1 (three strands of wire including a ground wire) is passed through the centers of the first finishing cap 150, the first packing 130, the coupling cap 170, and the first housing 112 (via through holes) and is connected to the first connection component 111 inserted into the first housing 112.

After this, when the first packing 130 is inserted into the inner circumference of the first wire entry end 113 of the first housing 112 and the first finishing cap 150 is coupled to the outer circumference of the first wire entry end 113, the first pressing member 151 of the first finishing cap 150 brings the first packing 130 into tight contact with the inner circumference and inside end of the first wire entry end 113 while pressing the first packing 130. In this case, the front end of the coupling cap 170 is located in the state in which the separation thereof is prevented between the first housing 112 and the first finishing cap 150.

Thereafter, the second connection component 121, i.e., an outlet, is inserted into one side of the second housing 122, and the second wire 2 (three strands of wire including a ground wire) is passed through the centers of the first finishing cap 160, the second packing 140, and the second housing 112 (via through holes) and is connected to the second connection component 121 inserted into the second housing 122.

After this, when the second packing 140 is inserted into the inner circumference of the second wire entry end 123 of the second housing 122 and the second finishing cap 160 is coupled to the outer circumference of the second wire entry end 123, the second pressing member 161 of the second finishing cap 160 brings the second packing 140 into tight contact with the inner circumference and inside end of the second wire entry end 123 while pressing the second packing 140.

Thereafter, the first connection component 111 and the second connection component 121 are electrically connected to each other by inserting the front end of the first housing 112 accommodating the first connection component 111 into the inner circumference of the second housing 122.

When the first connection component 111 and the second connection component 121 have been connected as described above, the other side end of the coupling cap 170 whose one side end is caught on the first housing 112 of the first connector 110 is located to correspond to the outer circumferential surface of the second housing 122 of the second connector 120, and then the coupling between the first housing 111 and the second housing 122 is allowed to be securely maintained by rotating the coupling cap 170.

Figure 8:
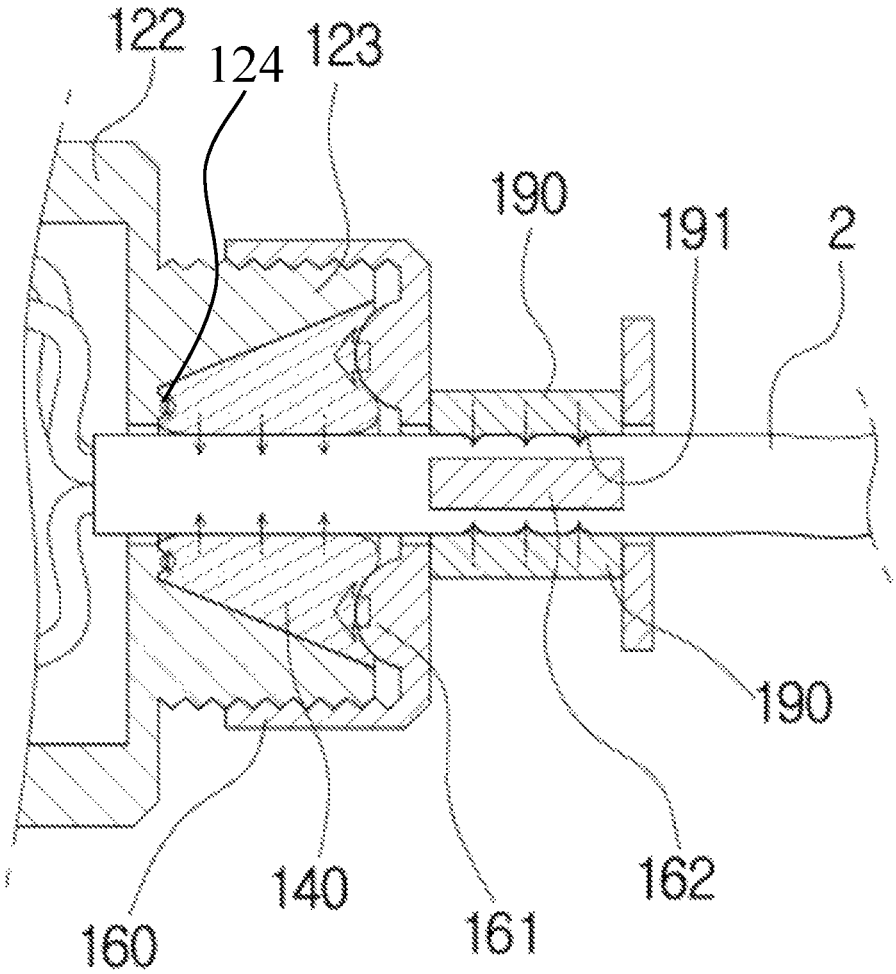
FIG. 8 is a partially sectional view showing the operation of the present invention.

According to the present invention as described above, as shown in FIG. 8, in the state in which the first and second packings 130 and 140 have been inserted into the inwardly narrowing inner circumferences of the first and second wire entry ends 113 and 123 provided on the first side ends of the first and second housings 112 and 122, respectively, the first and second finishing caps 150 and 160 are coupled to the outer circumferences of the first and second wire entry ends 113 and 123. Accordingly, the first and second pressing members 151 and 161 provided on the first and second finishing caps 150 and 160 press the first and second packings 130 and 140 onto the surfaces where the inner circumferences of the first and second wire entry ends 113 and 123 and the first and second wires 1 and 2 come into contact with each other. As a result, water can be prevented from infiltrating into gaps between the first and second wire entry ends 113 and 123 of the first and second housings 112 and 122 and the first and second packings 130 and 140, and also water can be prevented from infiltrating into gaps between the first and second packings 130 and 140 and the first and second wires 1 and 2 in a dual manner.

Furthermore, according to the present invention, in the state in which one side end of the coupling cap 170 has been inserted into the outer circumference of the first wire entry end 113, the other side end thereof is coupled to the outer circumference of one side end of the second housing 122 connected to the first housing 112, and the connection packing part 180 (the first and second elastic packings 181 and 182) are provided in the corresponding portions of the coupling cap 170 and the first housing 112 which come into contact with the front end and outer circumferential surface of the second housing 122 accordingly. Accordingly, the first connector 110 and the second connector 120 are allowed to remain connected. As a result, the connection between the first connector 110 and the second connector 120 can be prevented from being released by external pressure, and also water can be prevented from infiltrating into a gap between the connection portions of the first connector 110 and the second connector 120 in a dual manner, thereby maintaining water-tightness.

Moreover, according to the present invention, the pair of ribs 152 or 162 are symmetrically provided on both sides around the through hole on the outside of the front end of each of the first and second finishing caps 150 and 160. When the pair of wire movement prevention means 190 are screwed into the ribs 152 or 162 with the ribs 152 or 162 interposed therebetween, the opposite surfaces of the wire movement prevention means 190 or the stoppers 191 provided on the opposite surfaces press the wires. As a result, the connection of the first and second wires 1 and 2 connected to the first and second connection components can be prevented from being easily released by external pressure.

In this case, when the wire movement prevention means 190 have elasticity and are coupled to the front ends of the first and second finishing caps 150 and 160, water can be prevented from infiltrating into gaps between the first and second finishing caps 150 and 160 and the first and second wires 1 and 2.

Figure 9:
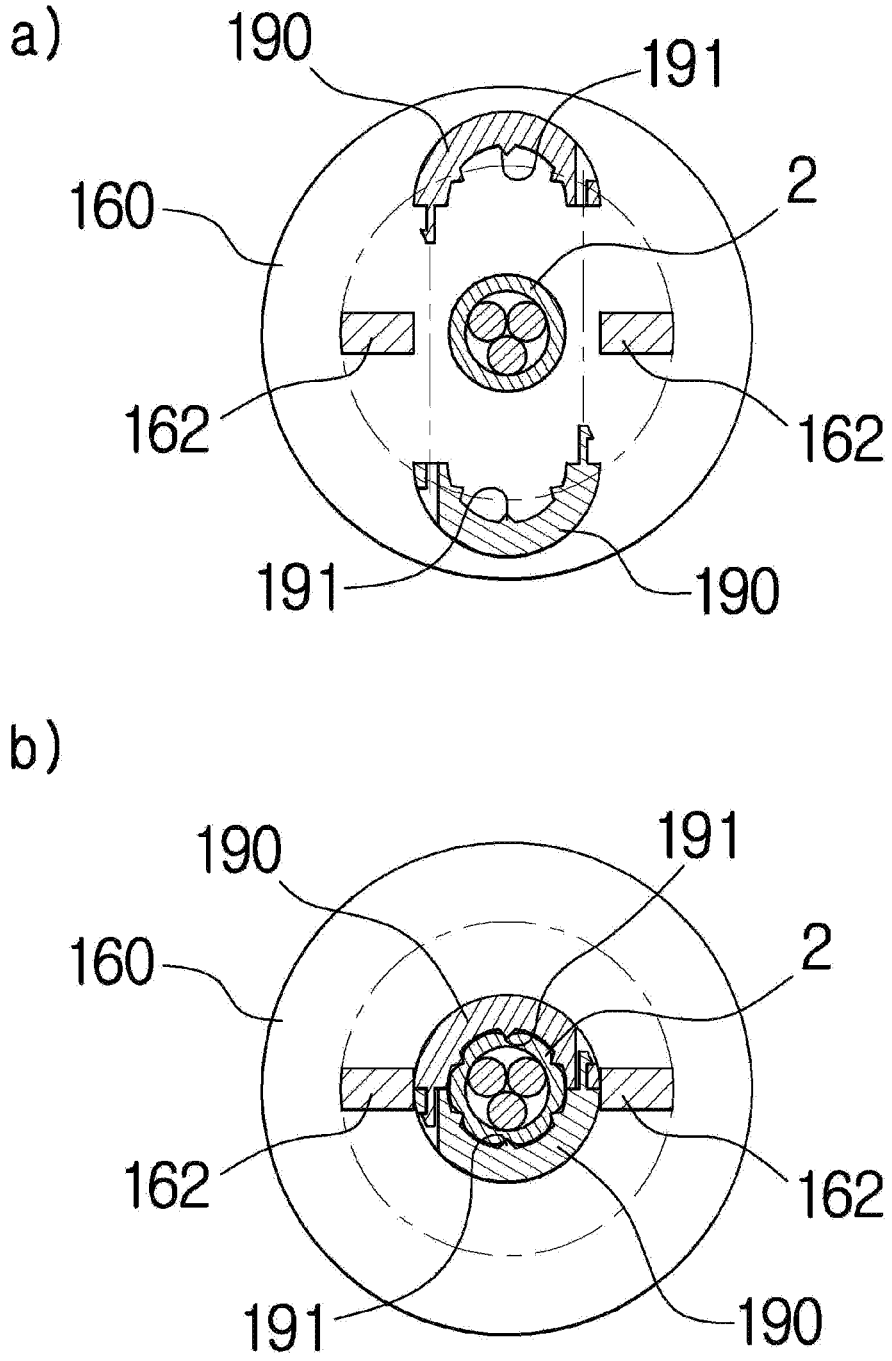
FIG. 9 is a sectional view showing another configuration of a wire movement prevention means in the present invention.

In the above-described present invention, as shown in a) and b) of FIG. 9, the pair of wire movement prevention means 190 are provided, and depressions and coupling protrusions are provided on the wire movement prevention means 190. Through the engagement of the depressions and the coupling protrusions, the opposite surfaces of the wire movement prevention means 190 or stoppers 191 provided on the opposite surfaces are allowed to press the wires. As a result, the connection of the first and second wires 1 and 2 connected to the first and second connection components can be prevented from being easily related by external pressure.

Although the present invention has been described and illustrated in connection with the preferred embodiments intended to illustrate the principle of the present invention, the present invention is not limited to the configurations and operations which are illustrated and described above.

Rather, it will be readily understood by a person skilled in the art that a plurality of variations and modifications may be made to the present invention without departing from the spirit and scope of the claims.

Therefore, all appropriate variations, modifications and equivalents should be viewed as falling within the scope of the present invention.

Description of reference symbols: 100: electric connector; 110: first electric connector; 111: first connection component; 112: first housing; 113: first wire entry end; 120: second electric connector; 121: second connection component; 122: second housing; 123: second wire entry end; 130 and 140: first and second packings; 150 and 160: first and second finishing caps; 151 and 161: first and second pressing members; 170: coupling cap; 180: connection packing; 181 and 182: first elastic packings; 2 and 190: wire movement prevention means

The invention claimed is:

1. A waterproof electric connector, comprising:

first and second connectors configured such that first and second wire entry ends whose inner circumferences narrow in inward directions are respectively provided at first side ends of first and second housings accommodating first and second connection components, respectively;

first and second packings configured to be inserted into the inner circumferences of the first and second wire entry ends in a surface contact manner and to maintain water-tightness;

first and second finishing caps formed as blocking components which are coupled to outer circumferences of the first and second wire entry ends in order to guide first and second wires into the first and second housings, and configured such that first and second pressing members are provided on portions of inner sides of front ends of the first and second finishing caps corresponding to first sides of the first and second packings in the form of ring-shaped protrusions and press the first and second packings in a direction toward surfaces along which the inner circumferences of the first and second wire entry ends come into contact with the first and second wires through pressing of first side surfaces of the first and second packings during a process of being coupled to the first and second wire entry ends;

a coupling cap configured such that in a state in which one side end thereof has been fitted over an outer circumference of the first wire entry end, a remaining side end thereof is coupled to an outer circumference of one side end of the second housing which is connected to the first housing; and a connection packing part including, in portions where the first and second housings are coupled to each other by the coupling cap:

a first elastic packing configured to be provided in a portion where the coupling cap and a front end of the second housing come into contact with each other, and to maintain water-tightness; and a second elastic packing configured to be provided in a portion where an inner circumferential surface of the second housing comes into contact with an outer circumferential surface of the first housing, and to maintain water-tightness, wherein an inner circumference of each of the first and second wire entry ends forms a central hollow shape in which a diameter of a front end thereof is long and a diameter thereof decreases in an inward direction, a ring-shaped pressing protrusion is formed on an inner hollow surface, and screw threads configured to be engaged with a corresponding one of the first and second finishing caps are formed on an outer circumferential surface of the first and second wire entry ends.

2. The waterproof electric connector of claim 1, wherein each of the first and second finishing caps is a cover configured such that a center thereof is formed to be hollow and screw threads are formed on an inner circumferential surface thereof so that the cover is coupled to a corresponding one of the first and second wire entry ends through engagement, and ribs configured to provide surfaces for coupling of wire movement prevention means are formed on both sides around a center through hole on an outside of a front end of each of the first and second finishing caps.

3. The waterproof electric connector of claim 2, wherein wedge-shaped stoppers configured to prevent movement are provided on curved surfaces of the wire movement prevention means which are in contact with the wires.

* * * * *